US006776574B1

(12) United States Patent
Parker

(10) Patent No.: US 6,776,574 B1
(45) Date of Patent: Aug. 17, 2004

(54) VARIABLE GEOMETRY TURBINE

(75) Inventor: John Frederick Parker, Huddersfield (GB)

(73) Assignee: Holset Engineering Company, Limited, Huddersfield (GB)

( * ) Notice: Subject to any disclaimer, the term of this patent is extended or adjusted under 35 U.S.C. 154(b) by 0 days.

(21) Appl. No.: 09/462,135

(22) PCT Filed: May 18, 1998

(86) PCT No.: PCT/GB98/01433

§ 371 (c)(1),
(2), (4) Date: Nov. 24, 2000

(87) PCT Pub. No.: WO98/57047

PCT Pub. Date: Dec. 17, 1998

(30) Foreign Application Priority Data

Jun. 10, 1997 (GB) ..... 9711893

(51) Int. Cl.[7] ..... F01D 17/14
(52) U.S. Cl. ..... 415/158
(58) Field of Search ..... 415/147, 156, 415/157, 158, 182.1

(56) References Cited

U.S. PATENT DOCUMENTS 1,322,810 A * 11/1919 Moody ..... 415/158 X
3,975,911 A 8/1976 Morgulis et al.
4,292,807 A 10/1981 Rannenberg
4,499,731 A 2/1985 Moser
4,499,732 A * 2/1985 Szczupak et al. ..... 415/158 X
4,557,665 A * 12/1985 Szczupak ..... 415/158
4,582,466 A 4/1986 Szczupak
4,779,423 A 10/1988 Szczupak
4,973,223 A 11/1990 Franklin
4,984,965 A 1/1991 McKean
5,025,629 A 6/1991 Woollenweber
5,044,880 A 9/1991 McKean
5,183,381 A 2/1993 McKean
5,522,697 A 6/1996 Parker et al.

FOREIGN PATENT DOCUMENTS

EP 0 034 915 9/1981
GB 1 554 074 10/1979

* cited by examiner

*Primary Examiner*—Edward K. Look
*Assistant Examiner*—Richard A. Edgar
(74) *Attorney, Agent, or Firm*—Woodard, Emhardt, Moriarty, McNett & Henry LLP

(57) ABSTRACT

A variable geometry turbine in which a turbine wheel is mounted to rotate about a pre-determined axis within a housing. A sidewall is displaceable relative to a surface of the housing to control the width of a gas inlet passage defined adjacent the wheel between the sidewall and the housing surface. The sidewall is supported on rods extending parallel to the wheel rotation axis, and the rods are displaced to control the displacement of the sidewall relative to the housing. The housing defines a chamber into which the rods extend such that one or more piston and cylinder arrangements are defined. The pressure within the chamber is controlled to control the axial position of the piston, the sidewall being displaced as a result of displacement of the piston.

4 Claims, 4 Drawing Sheets

VARIABLE GEOMETRY TURBINE

TECHNICAL FIELD OF THE INVENTION

The present invention relates to a variable geometry turbine incorporating a displaceable turbine inlet passage sidewall.

BACKGROUND OF THE INVENTION

U.S. Pat. No. 5,522,697 describes a known variable geometry turbine in which a turbine wheel is mounted to rotate about a pre-determined axis within a housing. An inlet passage to the turbine wheel is defined between a fixed wall of the housing and a sidewall which is displaceable relative to the fixed wall in order to control the width of an inlet passage. The sidewall is supported on rods extending parallel to the wheel rotation axis, and the rods are axially displaced relative to the housing so as to control the position adopted by the sidewall.

The rods are displaced by a pneumatic actuator mounted on the outside of the housing, the pneumatic actuator driving a piston. The actuator piston is coupled to a lever extending from a shaft pivotally supported by the housing such that displacement of the lever causes the shaft to turn. A yoke having two spaced apart arms is mounted on the shaft in a cavity defined within the housing. The end of each arm of the yoke is received in a slot in a respective sidewall support rod. Displacement of the actuator piston causes the arms to pivot and to drive the sidewall in the axial direction as a result of the interengagement between the arms and the sidewall support rods.

The known variable geometry turbine exhibits various disadvantageous features. In particular, pneumatic actuators typically incorporate an elustomeric diaphragm which is prone to failure, particularly in the temperature, piston stroke and pressure environment associated with variable geometry turbines. The shaft which supports the yoke is exposed to high temperatures but cannot be readily lubricated and therefore wear can arise. Furthermore, the engagement of the levers with the rods is of a sliding nature and although it is known to incorporate wear resistant materials, e.g. ceramics, in such assemblies, wear can still be a problem. Finally, mounting a pneumatic actuator outside the housing increases the overall size of the assembly which can be a critical factor in some applications.

SUMMARY OF THE INVENTION

It is an object of the present invention to obviate or mitigate one or more of the problems outlined above.

According to the present invention, there is provided a variable geometry turbine comprising a housing, a turbine wheel mounted to rotate about a pre-determined axis within the housing, a sidewall which is displaceable relative to the housing to control the width of a gas inlet passage defined adjacent the wheel between a first surface defined by the sidewall and a second surface defined by the housing, and displacement control means for controlling displacement of the sidewall relative to the housing, wherein the housing defines at least one chamber forming a cylinder which receives a piston defined by the sidewall, the sidewall is displaced as a result of displacement of the piston, and the displacement control means comprise means for controlling the pressure within the said at least one chamber to control the position of the sidewall relative to the housing.

The piston and cylinder may be annular.

The sidewall may be supported on guide rods extending parallel to the wheel rotation axis. The sidewall and guide rod assembly may be biased away from or towards the second surface by at least one spring. Each rod may be biased by one or more springs. The spring or springs may have a variable spring rate such that the rate of change of spring force with gas inlet passage width increases as the sidewall approaches the second surface. For example, each guide rod may be acted upon by two springs, one spring being compressed only when the sidewall approaches the housing surface.

Embodiments of the present invention will now be described, by way of example, with reference to the accompanying drawings, in which:

DESCRIPTION OF THE PREFERRED EMBODIMENT

Figure 1:
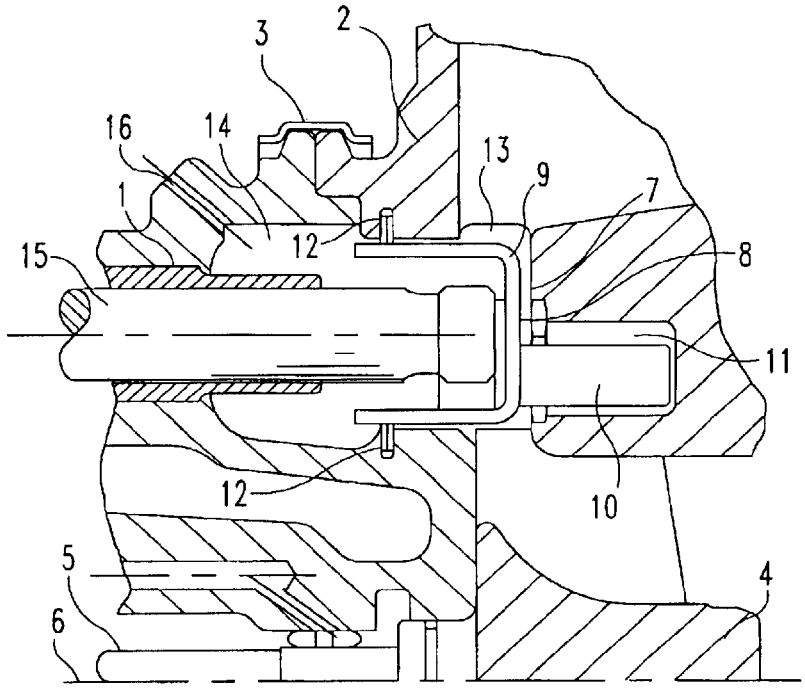
FIG. 1 is a sectional view of an upper half of a sidewall assembly of a variable geometry turbine in accordance with the present invention, the sidewall being shown in a position in which a gas inlet passageway is of minimum width.
Figure 2:
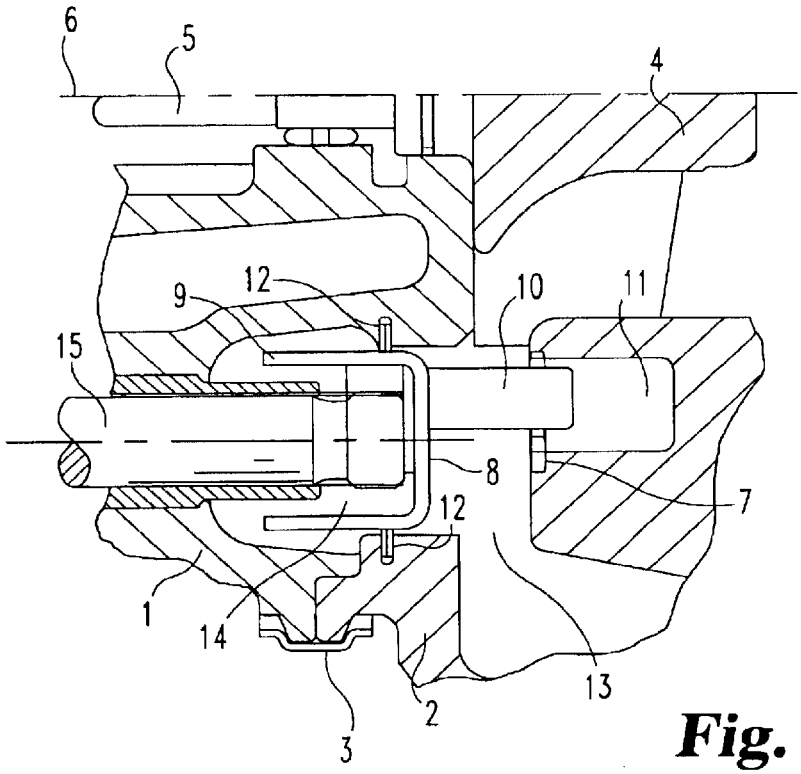
FIG. 2 shows the lower half of the sidewall assembly of FIG. 1 with the sidewall displaced to the fully open position.

Referring to FIGS. 1 and 2, the illustrated variable geometry turbine comprises a housing formed by a bearing housing 1 and a turbine wheel housing 2 clamped together with an annular clip 3, and a turbine wheel 4 mounted on a shaft 5 to rotate about an axis 6. The shaft 5 is supported on bearings within the bearing housing 1. The turbine housing 2 defines a surface 7 facing a surface 8 defined by a sidewall 9. The sidewall 9 in the illustrated assembly is shown formed from relatively thin steel and in cross-section is generally C-shaped, but it will be appreciated that the sidewall 9 could be for example a cast component. Vanes 10 mounted on the sidewall project from the surface 8 into an annular recess 11 defined in the housing. A sidewall which supports vanes as in the illustrated assembly is sometimes referred to as a "nozzle ring", but the term "sidewall" will be used herein.

Sealing rings 12 prevent gas flow between an inlet passageway 13 defined between the surfaces 7 and 8 and a chamber 14 located on the side of the sidewall remote from the vanes 10. Thus the sidewall 9 forms an annular piston received within an annular cylinder that defines the chamber 14. Support rods 15 on which the sidewall 9 is mounted extend into the chamber 14. An inlet 16 is formed in the bearing housing 1 to enable control of the pressure within the chamber 14. Increasing that pressure moves the sidewall 9 towards a fully closed position shown in FIG. 1, whereas reducing that pressure moves the sidewall 9 towards a fully open position as shown in FIG. 2.

Thus, the pressure within the chamber 14 is used to control the axial displacement of the sidewall 9. Means (not shown) are provided for controlling the pressure within the chamber 14 in accordance with a control program responsive to for example engine speed and torque and turbine pressures and temperature. The pressure control means is coupled to the inlet 16.

Figure 3:
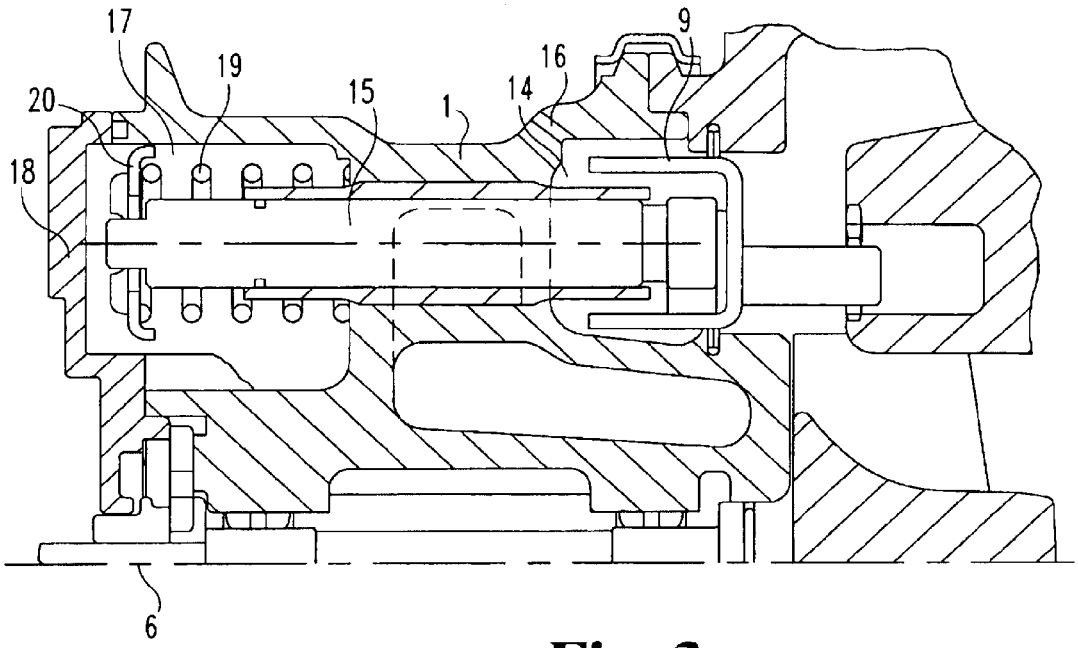
FIGS. 3 and 4 show alternative spring arrangements for the sidewall support rods shown in FIGS. 1 and 2.

Referring to FIG. 3, this illustrates one arrangement for spring-mounting the support rods 15 in the bearing housing 1. In the arrangement shown in FIG. 3, which corresponds to the sidewall 9 of FIGS. 1 and 2 in the fully open position, each support rod extends through a bore in the bearing housing 1 into a cavity 17. The cavity 17 is defined between the bearing housing 1 and a further housing component 18 coupled to the bearing housing 1. The pressure within cavity 17 is maintained close to atmospheric pressure.

The rod 15 is biased towards the left in FIG. 3 by a compression spring 19 compressed between the bearing housing 1 and a washer 20 retained on the end of the rod 15. Thus if the chamber 14 is vented to atmosphere, the rod 15 will assume the axial position shown in FIG. 3. If the pressure within the chamber 14 is then increased, the rod 15 and sidewall 9 will be displaced towards the right in FIG. 3 by a distance dependent upon the applied pressure.

Figure 4:
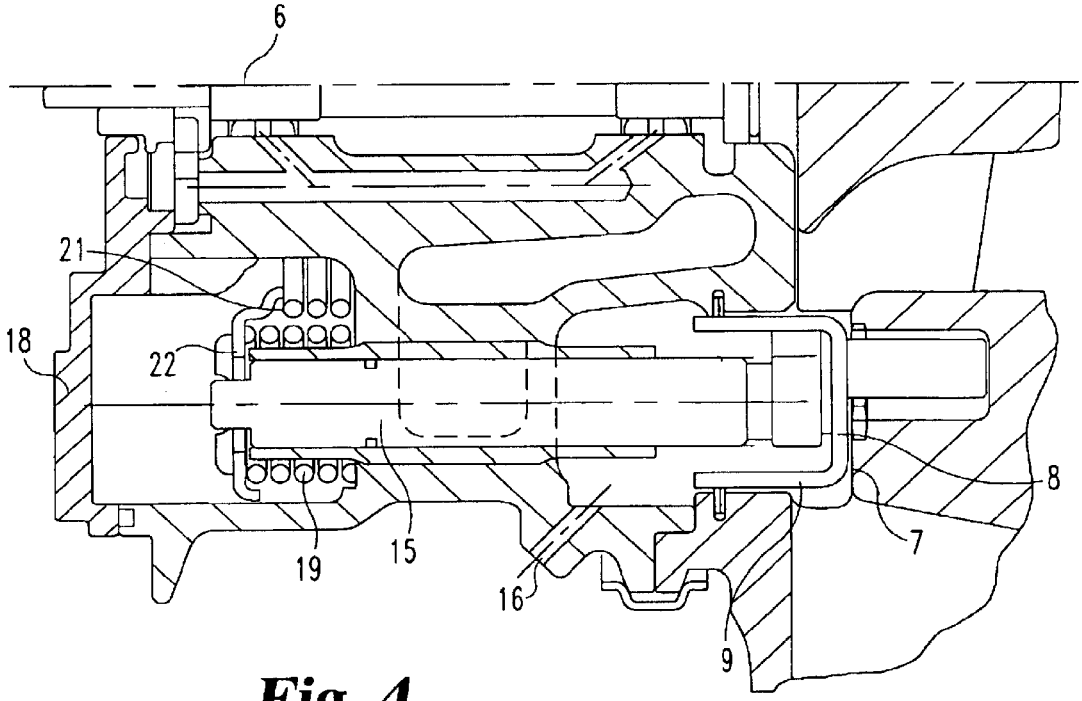

Referring now to FIG. 4, components equivalent to those described in FIG. 3 carry the same reference numerals. In the arrangement of FIG. 4 however it will be noted that a further compression spring 21 which is coaxial with the axis 6 bears against an annular support ring 22 which performs the same function as the washers 20 in the arrangement of FIG. 3. Each support rod 15 also extends through a coaxial compression spring 19. Thus the force driving the rod 14 to the left in FIG. 4 is the combination of the compression forces applied by the springs 19 and 21, and any axial forces applied to the sidewall 9 by the gas flowing through the inlet passage 13.

The springs 19 and 21 are arranged such that the return force applied to the rods 15 increases as the surface 8 of the sidewall 9 approaches the surface 7 defined by the turbine housing 2. For example, the spring 21 may have a length when in its relaxed state such that it does not oppose movement of the ring 22 to the right in FIG. 4 except when the sidewall 9 is relatively close to the surface 7. It has been found that this is an advantageous characteristic as the pressure within the inlet passage 13, which pressure acts on the surface 8, reduces as the surface 8 approaches the surface 7 due to the flow conditions within the gap defined between those two surfaces.

Figure 5:
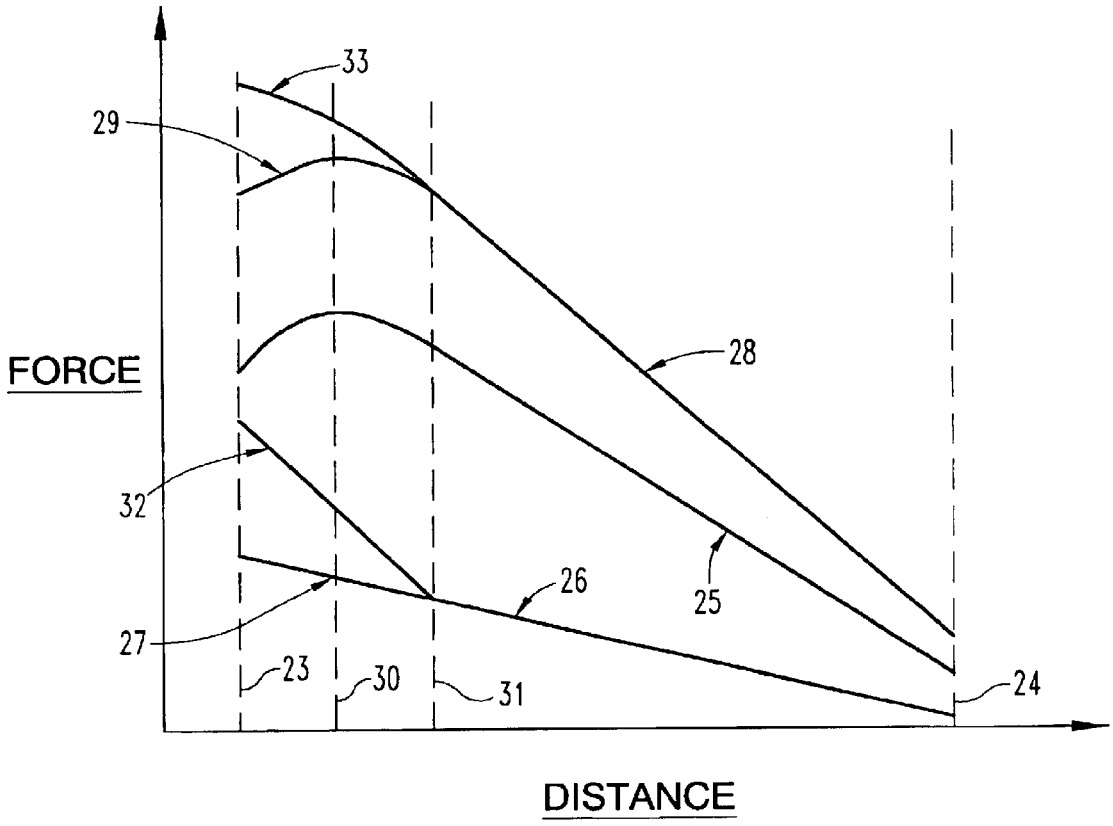
FIG. 5 is a schematic representation of characteristics of the spring assembly of FIG. 4 and the reactant gas force and resultant force on the sidewall of FIG. 4.

FIG. 5 illustrates the operational differences between an arrangement such as that described with FIG. 3, in which the spring 19 has a linear spring rate, and the arrangement of FIG. 4 in which the combination of springs 19 and 21 provides a non-linear spring rate. In FIG. 5, the curves represent axial forces applied to the assembly of components including the sidewall 9 as the distance between the surfaces 7 and 8 (the inlet passage width) is increased from a minimum 23 (fully closed as shown in FIG. 1) to a maximum 24 (fully open as shown in FIG. 2).

Curve 25 of FIG. 5 represents the variation of axial force due to reactant gas forces on the surface 8 of the sidewall 9. It will be noted that as the passage width is reduced the reactant gas force initially rises in a substantially linear fashion but then falls as the sidewall 9 approaches the surface 7 of the turbine housing 2. The curves 26 and 27 represent the force applied by the spring 19 of FIG. 3. The curves 28 and 29 represent the resultant axial force on the sidewall 9, the resultant force reducing with reduction in passage width beyond the distance indicated by line 30. Thus with an arrangement as shown in FIG. 3 in which the springs 19 have linear characteristics, the axial position of the sidewall 9 is unstable when the inlet passage width is reduced to the limit represented by line 30. In particular, there will be a tendency for the sidewall to be moved rapidly to the minimum width position in an uncontrolled manner as soon as is passes the position represented by line 30.

With the arrangement of FIG. 4, the spring 21 has no effect when the inlet passage width is in the range represented by the distances between the lines 24 and 31. As soon as the passage width is reduced to the limit represented by line 31 however, further reductions in the passage width compress both the spring 21 and the springs 19. As a result the combined spring characteristic is as represented by lines 26 and 32, and the resultant is represented by lines 28 and 33. Thus the resultant of the spring and reactant gas forces increase continuously as the inlet passage width reduces to the minimum represented by line 23. Instability in the axial position of the sidewall 9 is thus avoided.

Figure 6:
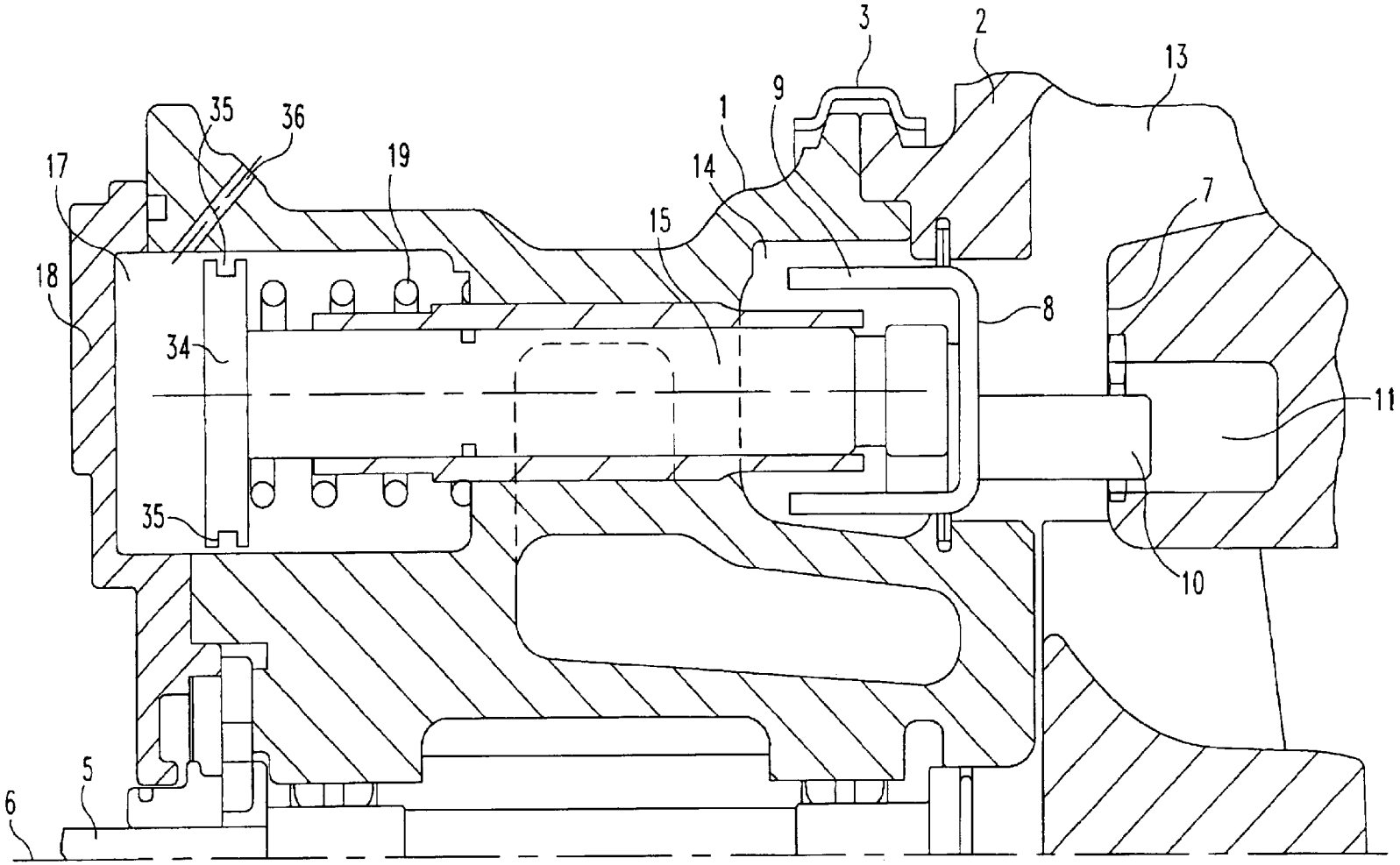
FIG. 6 is a sectional view representing an alternative control assembly for a sidewall support rod.

Referring to FIG. 6, the same reference numerals are used as in FIGS. 1 to 4 however, rather than the chamber 14 and the sidewall 9 defining a piston and cylinder arrangement, each rod 15 is coupled to an annular piston 34 which supports sealing rings 35 such that pressure within the chamber 17 on the side of the piston 34 remote from the spring 19 indirectly controls the axial position of the rods 15 by controlling the axial position of the ring 34. The differential pressure across the piston 34 is controlled by controlling the pressure within a control air inlet 36. The pressure on the spring side of piston 34 is maintained close to atmospheric.

With the arrangement of FIG. 6, apertures (not shown) may be provided through the sidewall 9 to open into face 8 and thereby reduce the force differential across the sidewall as described in U.S. Pat. No. 5,522,697. Such an arrangement is not possible if the cavity immediately behind the sidewall is used as a control cylinder as in the case of the arrangements of FIGS. 1 to 4.

In some circumstances, it is desirable to bias the sidewall to a fully closed position, rather than towards a fully open position as in the arrangements of FIGS. 1 to 4 and 6. This could be achieved by placing the springs 19 shown in FIG. 6 on the left of the piston 34 rather than on the right, and positioning the control pressure inlet 36 to communicate with the right hand end of the cavity 17.

It will also be appreciated that although the moveable sidewall 9 is positioned in the bearing housing 1 of the illustrated arrangements, the sidewall could be supported in the turbine housing 2 by reversing the locations of the relevant components with respect to the inlet passage 13. This would make it possible to achieve cost reductions by using a common bearing housing 1 for both fixed and variable geometry turbines.

The present invention provides various advantages as compared with the known variable geometry turbine. Firstly, as no actuator mechanically coupled to the sidewall is required, the problems associated with such actuators are avoided. Secondly, as mechanical couplings between an actuator and the sidewall have been eliminated, potential points of wear are also eliminated. This could be achieved by placing the springs 19 shown in FIG. 6 on the left of the piston 34 rather than on the right, and positioning the control pressure inlet 36 to communicate with the right hand end of the cavity 17.

Having thus described the invention, what is claimed as novel and desired to be secured by Letters Patent of the United States is:

1. A variable geometry turbine comprising a housing, a turbine wheel mounted to rotate about a pre-determined axis within the housing, a sidewall which is displaceable relative to the housing to control the width of a gas inlet passage defined adjacent the wheel between a first surface defined by the sidewall and a second surface defined by the housing, and displacement control means for controlling displacement of the sidewall relative to the housing, wherein the housing defines at least one chamber forming an annular cylinder which receives a piston comprising an annular member coupled to and defined by the sidewall, the sidewall is displaced as a result of displacement of the piston, and the displacement control means comprise means for controlling the pressure within the said at least one chamber to control the position of the sidewall relative to the housing said sidewall being supported on guide rods parallel to the wheel rotation axis, said guide rods being biased by at least one spring away from the second surface.

2. A variable geometry turbine according to claim 1, wherein each rod is biased by at least one spring away from the second surface.

3. A variable geometry turbine according to claim 2, wherein the said at least one spring has a variable spring rate such that the rate of change of spring force with gas flow passage width increases as the sidewall approaches the second surface.

4. A variable geometry turbine according to claim 3 wherein each rod extends through a respective compression spring bearing against the housing and the rod, and a further compression spring is arranged to bear against the end of each rod, the said further spring being compressed only when the sidewall approaches the second surface.

* * * * *